United States Patent [19]

Celeste et al.

[11] Patent Number: 4,905,926

[45] Date of Patent: Mar. 6, 1990

[54] FRICTIONLESS JOURNAL TAKE-UP CLUTCH

[75] Inventors: Joseph A. Celeste, Trumansburg; Gary A. Wojdyla, Ithaca, both of N.Y.

[73] Assignee: NCR Corporation, Dayton, Ohio

[21] Appl. No.: 769,999

[22] Filed: Aug. 26, 1985

Related U.S. Application Data

[63] Continuation of Ser. No. 546,693, Oct. 28, 1983, abandoned.

[51] Int. Cl.[4] ..... B65H 18/12

[52] U.S. Cl. ..... 242/67.3 R

[58] Field of Search ..... 242/67.2, 75.51, 67.3 R; 192/84 PM; 464/1, 29; 310/92, 105; 226/157

[56] References Cited

U.S. PATENT DOCUMENTS

| | | | |
|---|---|---|---|
| 539,964 | 5/1895 | Spencer | 226/157 X |
| 2,290,041 | 7/1942 | Gautier | 226/157 |
| 2,481,360 | 9/1949 | Sprenger | 464/29 X |
| 3,275,259 | 9/1966 | Gamberini | 242/75.44 |
| 3,371,883 | 3/1968 | Hoffman et al. | 242/67.3 R |
| 3,429,523 | 2/1969 | Busch | 242/67.3 R |
| 3,584,250 | 6/1971 | Bottani | 310/105 X |
| 3,628,713 | 12/1971 | Deproux | 226/157 |
| 3,967,790 | 7/1976 | Hess | 242/67.2 |
| 4,209,139 | 6/1980 | Alper | 242/67.3 R |
| 4,247,212 | 1/1981 | Wu | 400/559.1 X |

FOREIGN PATENT DOCUMENTS

| | | | |
|---|---|---|---|
| 570696 | 2/1959 | Canada | 226/157 |

*Primary Examiner*—Harvey C. Hornsby
*Assistant Examiner*—Scott J. Haugland
*Attorney, Agent, or Firm*—Wilbert Hawk, Jr.; George J. Muckenthaler

[57] ABSTRACT

A pair of mating magnetic rings are arranged in a pattern wherein the magnetic fields of the rings act on each other in a manner so that when one ring is rotated, the other ring follows in rotating fashion until a predetermined torque level is reached, after which the other ring will slip in reaction to the opposing field.

3 Claims, 3 Drawing Sheets

FRICTIONLESS JOURNAL TAKE-UP CLUTCH

This is a continuation of co-pending application Ser. No. 546,693 filed on Oct. 28, 1983, abandoned.

BACKGROUND OF THE INVENTION

In the printing field wherein paper or like record media is caused to be transported past a line of printing, it is a well-known fact that precise control of the paper, as it is driven past the printing line, is important to effect good print quality. In a journal printed, a supply roll of paper is carried on a spindle or supply roller positioned in one area or section of the printer and a take-up roller is supported or contained in another area or section of the printer. The journal paper, as it travels from the supply roll to the take-up roll, is directed or guided in a path past the line of printing, and it is essential that the tension or tautness of the paper be maintained in a desired attitude or condition from one roll to the other roll for good printing operation.

Additionally, it is important that the tension or tautness of the paper is controlled when the paper is rolled or rewound onto the take-up roller so as to effect or provide a smooth and uniform roll of journal paper in a rewound condition. One method of controlling the tension in the paper and the condition of the layers of paper as they are rewound onto the take-up roller is by means of a spring-loaded, friction type clutch. The friction type clutch provides that the journal paper is generally under a constant tension by reason that the take-up roller may be friction-controlled or under spring tension. It is also seen that any frictional forces occurring during the take-up operation as a result or by reason of such constant tension on the paper may prevent realignment of certain layers of the paper which have become skewed in the rewinding operation. It is desirable that some means be provided in the paper take-up apparatus for better controlling the attitude and condition of the journal paper so as to maintain the paper under proper tension as it is being driven or transported past the line of printing during the printing operation, while at the time of transporting or advancing permitting the paper to be evenly, uniformly and precisely rolled onto the take-up roller.

Representative documentation in the field of the control of paper or like strip material rollers includes U.S. Pat. No. 3,275,259, issued to G. Gamberini on Sept. 27, 1966, which discloses a supply roll brake using a spring friction coupling formed by a disk, a free-wheeling device and a spring-loaded brake for controlling strip material as it is drawn from a spool.

U.S. Pat. No. 4,209,139, issued to D. D. Alper on June 24, 1980, discloses a paper take-up mechanism which uses a single slip drive system and one or more paper rewind coils to simultaneously apply forward driving force to one or more paper rolls.

U.S. Pat. No. 4,247,212, issued to E. S. Wu on Jan. 27, 1981, discloses a printer platen clutch having releasable coupling means allowing printer controlled or manual indexing of the platen and including an external clutch member which is rotatably mounted and spring urged along a shaft, an internal clutch member fixedly mounted on the shaft and having an external cone clutch element normally engaged with the internal element by the spring, and a manual clutch disengaging member axially movable along the shaft.

SUMMARY OF THE INVENTION

The present invention relates to printing mechanism having a paper or like journal material supply roll and wherein a journal take-up roll is controlled in precise manner to effect a smooth and uniform rewinding of the paper. More particularly, a journal paper take-up roller is controlled by means of a frictionless take-up clutch which employs a pair of clutch members in the nature of input and output ring magnets of different diameters cooperating to produce magnetic forces for transmitting an output torque to the take-up roller. The ring magnets are oriented in a fashion wherein their magnetic fields act on each other so that when the magnets are oriented in the position where opposite pole pairs are aligned, the poles attract each other and no torque is transmitted to the output. As the input ring magnet is rotated, the output ring magnet is loaded and the pole pairs begin to offset in angular manner and the poles tend to repel each other. As the load increases, the repelling forces of the aligned, similar or like poles and the attracting forces of aligned, opposite poles reach a peak condition. At this time, those poles causing the driving motion of the output ring come under the influence of the adjacent (consequentially opposite polarity) poles, to be in the reverse direction, thereby removing all tension and adding some slack to the journal take-up roll. The input and output magnetic rings then realign to the-next set of pole pairs and the action is repeated in cyclic manner. This action produces a cyclic momentary motion in the reverse direction on the output shaft and take-up roller and thereby provides an even and correct tension on the paper for precisely taking up or rewinding the journal roll.

A preferred embodiment of the present invention uses a pair of magnetic rings which are straight lined in a rectangular configuration and have parallel surfaces mating and cooperating magnetically with each other to transmit the required torque for controlling the attitude of the paper in the rewinding thereof on the journal roll. The ring magnets comprise internal and external clutch members operably associated with a common shaft to provide the cyclic motion to the journal paper take-up roll.

A modification of the structure of the present invention provides a pair of magnetic rings which have sloping or slanted, mating surfaces and which are magnetically cooperating with each other to transmit the required torque for controlling the attitude of the paper in the rewinding thereof on the journal roll and additionally, for enabling adjustment of the air gap between the magnetic rings to vary the value of the transmitted torque. The external clutch member is rotatably journaled on the output shaft and is movable therealong to change the air gap and the resulting torque.

In view of the above discussion, the principal object of the present invention is to provide a frictionless clutch for controlling the rotation of a journal paper take-up roller in a printer.

Another object of the present invention is to provide a magnetic clutch to produce an output torque to effect cyclic momentary motion on the journal take-up roller.

An additional object of the present invention is to provide a magnetic clutch having ring magnets in an arrangement wherein opposed pole pairs cooperate under the influence of rotary motion to produce a cyclic output torque on the take-up roller.

A further object of the present invention is to provide a magnetic clutch having a pair of magnetic rings of different diameters and including equally-spaced pole pairs operable to transmit a precise output torque in cyclic motion on the take-up roller.

Still an additional object of the present invention is to provide a magnetic clutch to effect cyclic momentary reverse motion.

Still a further object of the present invention is to provide a frictionless clutch for long life operation without influence by outside factors, such as wear, dirt, dust or debris, by reason of lack of friction or contact between torque transmitting members.

Additional advantages and features of the present invention will become apparent and fully understood from a reading of the following description taken together with the annexed drawing.

DESCRIPTION OF THE PREFERRED EMBODIMENT

Figure 1:
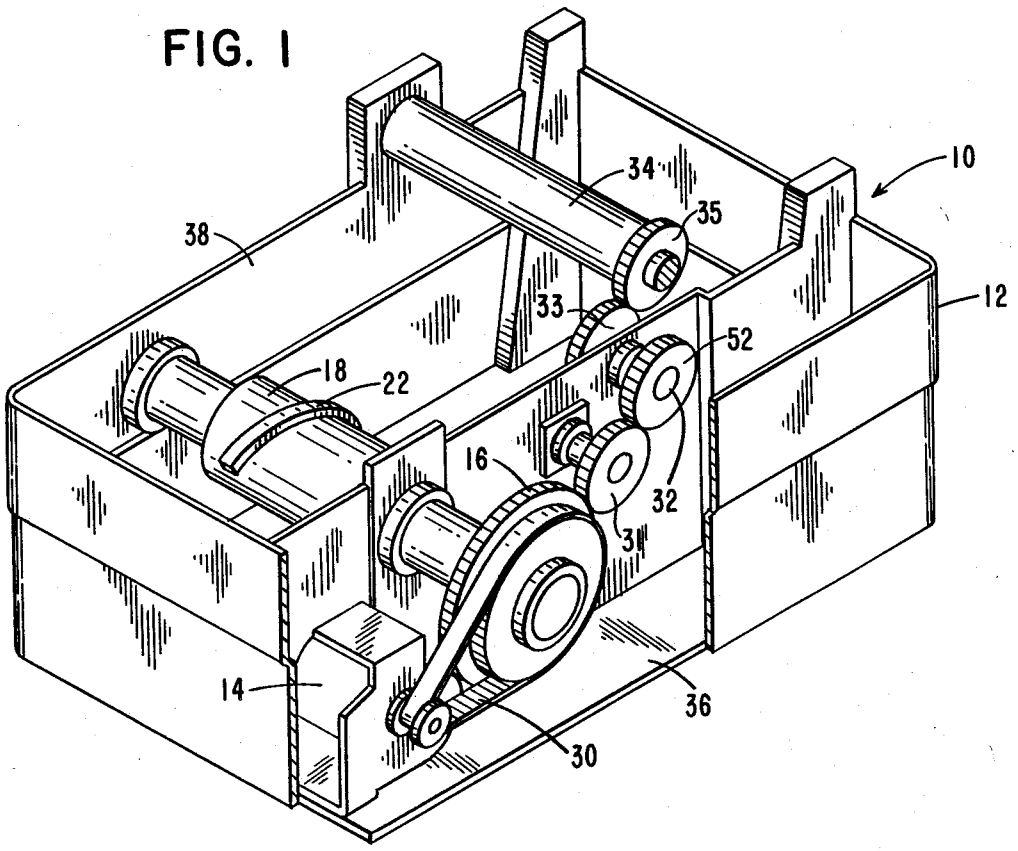
FIG. 1 is a right front perspective view of a matrix printer incorporating the subject matter of the present invention.
Figure 2:
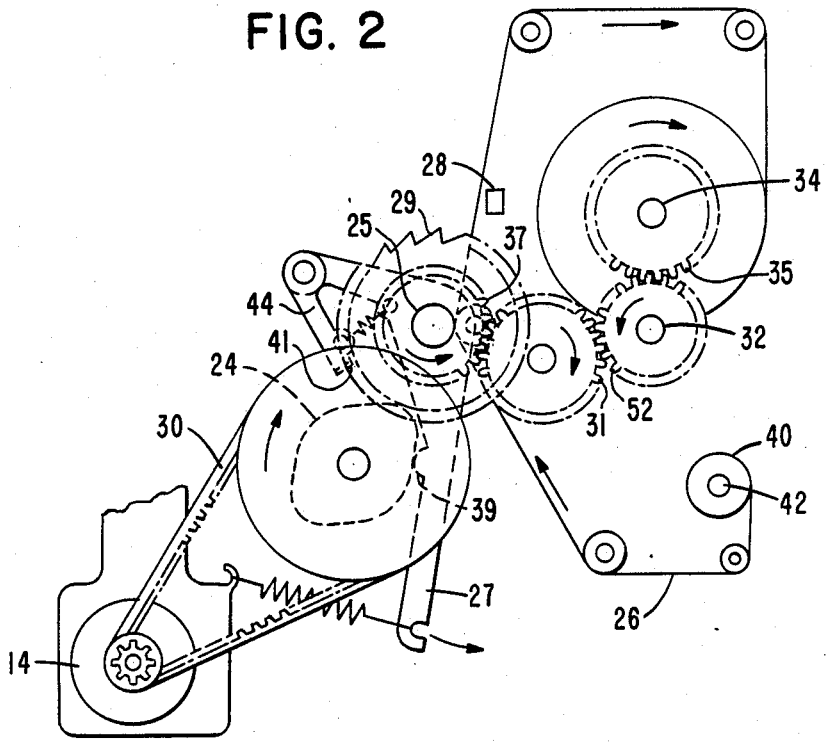
FIG. 2 is a side elevational view showing the arrangement of certain of the parts of the matrix printer of FIG. 1.

Referring now to FIG. 1, there is shown a printer of the dot matrix type generally designated as 10, the top cover or portion thereof being removed to illustrate certain of the interior working parts which are contained within an enclosure 12 which assumes a rectangular shape and provides protection for a compact high-speed printer. A drive motor 14 is positioned to drive a cluster of gears 16, a cam line 18, and suitable means for driving a ribbon (not shown) in continuous manner past the printing station. The cam line 18 is continuously driven and includes a drum cam 22 and an incremental cam 24 (FIG. 2). The drum cam 22 provides side-to-side drive or movement for a print carriage (not shown) which carries a plurality of printing solenoids for printing in dot matrix manner on printing paper 26 or like record media. The incremental cam 24 activates a drive member 27 to cause the paper 26 to be moved past or across a platen 28, such platen being in the shape of a flat bar disposed laterally across the printer 10. The drive member 27 simultaneously provides driving motion to the shaft 32 for the journal paper take-up roller 34 through the cluster of gears 16.

The cluster of gears 16 is included as a portion of the operating or working mechanism to provide the driving arrangement from the drive motor 14 through a timing belt 30 trained around a pulley on the motor shaft and around a pulley on a shaft carrying the drum cam 18, and also the driving arrangement to the shaft 32 for the journal paper take-up roller 34. It is of course within the realm of the present disclosure that other ways and means could be provided to effect a driving connection from the motor 14 to the shaft 32.

In the preferred arrangement of the present invention, the shaft 32 is supported from suitable bearings in side frames 36 and 38 of the printer and the shaft extends across the printer in a position to enable rewinding of the journal or audit paper on the take-up roller 34 driven by the shaft 32. As seen in the side elevation of FIG. 2, a supply roll 40 of paper 26 is provided on a supply roller 42 journaled in the side frames 36 and 38 of the printer. The paper 26 is trained in a path from the supply roll 40 past the platen 28 and the line of printing and then onto and around the take-up roller 34. The take-up shaft 32 which drives the roller 34 is caused to be incrementally driven to advance the journal paper 26 by means of the cam-operated or actuated drive member 27. The printing solenoids are caused to be moved a distance of approximately one inch during the printing operation, which includes printing in each direction of movement of the print carriage. At the end of each line of printing, the paper is caused to be moved by an incremental dot feed arm 44 wherein, in the case of a seven dot height matrix character, the feed arm or drive member will advance the paper a total of seven times to complete a line of character printing.

Figure 3:
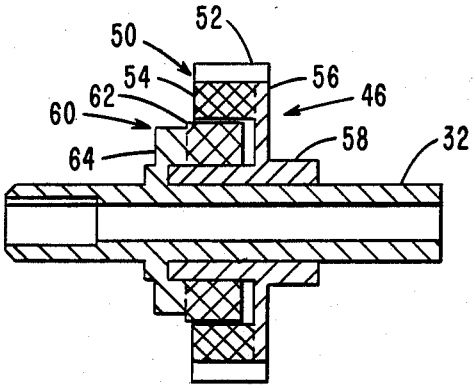
FIG. 3 is a side elevational view, partly in section, of a preferred construction of the magnetic clutch for the journal take-up roller.

As seen in FIG. 3, a clutch assembly generally designated as 46, includes as a part thereof the shaft 32 on which is journaled or rotatably supported an external clutch member 50. The clutch member 50 comprises a gear portion 52 on the periphery thereof which meshes with the gear operably associated with the drive member 44 and provides the input driving force to the clutch assembly. Adjacent the gear portion 52 is an annular flange portion 54 of a certain thickness and formed in integral manner with a connecting portion 56 to the journal or bearing portion 58. The flange portion 54 is a magnetic ring structure and is comprised of a plurality of magnetic pole pairs equally spaced circumferentially around the inside surface of the ring.

An internal clutch member 60 is fixed on or secured to the shaft 32 and is positioned to operate with the external clutch member 50. The internal member 60 is formed and constructed to provide a flange portion 62 and a connecting portion 64 integral therewith and which secures the portion 62 to the shaft 32. The flange portion 62 is a magnetic ring structure and is comprised of a plurality of magnetic pole pairs of equal number, as on the flange portion 54, and equally spaced circumferentially around the outside surface of the ring.

Each of the clutch members 50 and 60 has a rectangular cross-sectional area wherein the magnetized portions include North and South poles which cooperate in theoretical magnetic fashion relative to each other in repelling and attracting action and motion. The magnetic members 50 and 60 are oriented and carried on a common axis with the external member 50 providing the input driving force to the clutch assembly 46 and the internal member 60 providing the output driving force to the journal paper take-up roller 34. The action and reaction forces are produced from the magnetic forces which are developed between the pole pairs of one member, for example, member 50 with respect to the opposite pole pairs of the other member 60 to cause a torque to be transmitted to the output shaft 32. When the input ring or clutch member 50 is caused to be rotated relative to the output ring or clutch member 60, the lines of flux developed between the pole pairs causes such outputting to be rotated.

Initially, it is seen that when the pole pairs are aligned so that a North pole and a South pole are opposite each other in attracting manner, the effect is that both the magnetic rings 50 and 60 are held in a stationary manner and no torque is transmitted to the output shaft 32. As the drive gear or input clutch member 50 starts to rotate, the output clutch member 60, along with the shaft 32, also starts to rotate and is subjected to external loading thereby developing torque by means of the lines of flux developed by the pole pairs beginning to be offset from each other. The offset of the North and South poles to a rotated position from the aligned position invites similar poles to approach each other and such similar poles tend to follow the theory of repulsion in well-known manner. The combination of these magnetic forces begins applying torque to the output shaft 32 and as the load increases on the assembly, the offset of the pole pairs increases from the aligned position. As the magnetic attraction of the opposite poles and the repelling forces of the similar poles are terminated or broken in a condition wherein a peak torque is reached, the repelling forces of the similar poles and the attracting forces of the opposite poles of the adjacent pole pairs cause the output ring or clutch member 60 along with the take-up shaft 32 to be driven or rotated in a reverse or backward direction. The magnetic rings of the clutch assembly then realign to the next set of pole pairs and are then in a position to repeat the action. Since the operation of the take-up roller is provided and maintained at a low rotational speed, the action produces a cyclic momentary motion of reverse direction on the output shaft 32 wherein the momentary direction reversal is peculiar and unique in a journal paper take-up application.

Figure 4:
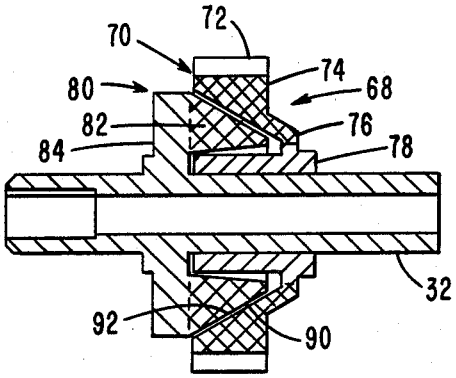
FIG. 4 is a side elevational view, partly in section, of a modified structure of the magnetic clutch.

FIG. 4 illustrates a modified clutch assembly generally designated as 68, wherein an input drive is provided by an external clutch member 70 and includes a gear portion 72 which meshes with the gear operably associated with the drive member 44 and provides the input driving force to the clutch assembly. Adjacent the gear portion 72 is an annular flange portion 74 of a certain thickness and formed in integral manner with a connecting portion 76 to the journal or bearing portion 78. The flange portion 74 is a magnetic ring structure and is comprised of a plurality of magnetic pole pairs equally spaced around the inside surface of the ring 70.

An internal clutch member 80 is fixed on or secured to the shaft 32 and is positioned to operate with the external clutch member 70. The internal member 80 is formed and constructed to provide a flange portion 82 and a connecting portion 84 integral therewith and which secures the portion 82 to the output shaft 32. The flange portion 82 is a magnetic ring structure and is comprised of a plurality of magnetic pole pairs of equal number, as on the flange portion 74, and equally spaced around the outside surface of the ring.

Each of the rings 70 and 80 has a rectangular cross-sectional area except that the modified structure of the clutch assembly 68 includes a conical-shaped form wherein sloping surfaces 90 and 92 are provided between the external member 70 and the internal member 80. The sloping or chamfered surface 90 of the member 70 is on the inside of the ring and the mating surface 92 of member 80 is on the outside of the ring to provide an air gap 94 between the sloping surfaces.

Since the magnetic rings 80 and 70 of the clutch assembly 68 are on a common shaft and since the external clutch member or ring 70 is rotatably journaled on the shaft 32, such member 70 can be moved along the shaft a short precise distance to effect a variation in the air gap between surfaces 90 and 92 and a resulting change in the torque transmitted to the output shaft 32 and to the journal paper take-up roller 34.

Figure 5:
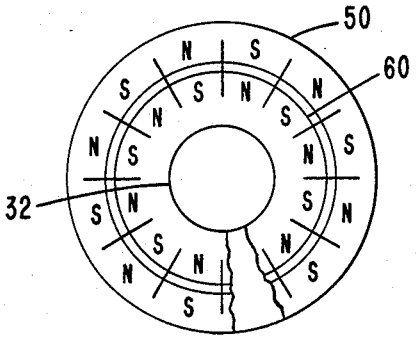
FIG. 5 is a view illustrating the magnetic pole pairs of the clutch elements.

FIG. 5 illustrates the arrangement of the north and south poles of each of the clutch members 50 and 60 for the preferred clutch assembly 46, and of the clutch members 70 and 80 for the modified clutch assembly 68. The magnetized portions or pole pairs for each of the clutch assemblies are arranged in the same fashion but are different in form, as seen in FIGS. 3 and 4.

The magnetic clutch eliminates the constant tension conditions on the paper or record media 26 normally associated with friction-type clutches. The present invention provides for varying tension conditions on the paper 26 wherein at the time of highest torque being transmitted to the output shaft 32 a tension peak is realized and conversely, when no torque is being transmitted, a zero or minimum tension is experienced in the paper. The sequence of low tension and high tension conditions in the paper 26 allows the layers of the journal take-up roll 34 to realign in a manner as were the layers on the supply roll 40. The tension peak on the paper 26 that follows a condition of no tension provides for tightening of the paper on the take-up roller 34 and the action repeats with the next motion of the clutch assembly. The result is that uniform rolls of paper 26 are rewound on the take-up roller 34.

FIG. 3 shows the preferred structure wherein the air gap between the input ring and the output ring is fixed and an exact and predetermined torque is transmitted to the take-up roller 34. FIG. 4 illustrates the modified structure wherein the air gap between the magnetic rings may be changed by axial movement of the input ring and the transmitted torque may be varied.

It is thus seen that herein shown and described is a magnetic clutch assembly that provides a cyclic momentary motion of low and high torque conditions for rewinding journal paper and to assure even and uniform layers of paper on the take-up roll. It is also to be noted that the number of pole pairs of the clutch assembly may be changed to satisfy different incremental drive motions for desired applications. The present invention enables the accomplishment of the objects and advantages mentioned above, and while a preferred embodiment and a modification of the invention have been disclosed herein, other variations may occur to those skilled in the art. It is contemplated that all such variations and modifications not departing from the spirit and scope of the invention hereof are to be construed in accordance with the following claims.

We claim:

1. A take-up assembly for record media used in a printer comprising a drive motor, a shaft, a take-up roller supported from the printer, and means interconnecting the drive motor and the take-up roller including ratchet means for incremental driving thereof, said interconnecting means including an external magnetic ring clutch member defining a cone-shaped interior surface and having a flange portion of one diameter rotatably mounted on the shaft and axially movable therealong and providing an input from the drive motor and having a plurality of adjacent north and south pole pairs equally spaced around the cone-shaped interior surface of the external clutch member and an internal magnetic ring clutch member defining an exterior surface mating with said cone-shaped interior surface and having a flange portion of a lesser diameter fixedly mounted on the shaft and providing an output to the take-up roller and having a plurality of adjacent north and south pole pairs equally spaced around the exterior surface of the internal clutch member and magnetically opposed to the pole pairs of the external clutch member, said external clutch member and said internal clutch member having generally triangular cross-sectional portions defining chamfered surfaces and each having the plurality of adjacent magnetic pole pairs occupying the entire circumference of the chamfered surfaces of the respective clutch member in flanged and overlapping relationship wherein the flange portion of said external clutch member extends and overlaps the flange portion of said internal clutch member and cooperating in cyclic repulsion and attraction manner as the external clutch member is incrementally rotated in one direction and operably associated with the internal clutch member to rotate the take-up roller to a position of maximum torque for providing tautness of the record media past the print station of the printer and wherein the combination of repelling forces and attracting forces causes momentary reversal in direction and alternate tightening and loosening of the record media on the take-up roller.

2. A magnetic clutch for use in a printer having drive means, a record media take-up roller, and a shaft operably associated with the roller, said clutch comprising an external magnetic ring clutch member having a flange portion of one diameter journaled on the shaft and providing an input from the drive means and having a plurality of adjacent north and south pole pairs equally spaced around the interior surface of the external clutch member and an internal magnetic ring clutch member having a flange portion of a lesser diameter fixed on the shaft and providing an output to the take-up roller and having a plurality of adjacent north and south pole pairs equally spaced around the exterior surface of the internal clutch member and opposed to the pole pairs on the external clutch member, said clutch members having generally rectangular cross-sectional portions defining substantially concentric mating surfaces spaced from each other to provide an air gap therebetween and each having the plurality of adjacent magnetic pole pairs on the respective mating surfaces occupying the entire circumference of the respective clutch member in flanged and overlapping relationship wherein the flange portion of said external clutch member extends and overlaps the flange portion of said internal clutch member and cooperating in cyclic manner to provide momentary motion in one direction of rotation of the shaft subsequent to rotation in the opposite direction by reason of the combination of repelling forces and attracting forces producing a maximum torque and a minimum torque in the internal clutch member for providing tautness of the record media and for relaxing of the record media for uniformly rewinding the record media on the take-up roller in the course of incremental driving thereof.

3. In a printer having a drive motor and means for storing record media by rewinding thereof comprising a shaft, a record media take-up roller supported from the printer, and a clutch assembly operably connected with the drive means and with the take-up roller and comprising an external magnetic ring clutch member having a flange portion of one diameter journaled on the shaft and providing an input from the drive motor and having a plurality of adjacent north and south pole pairs equally spaced around the interior surface of the internal clutch member and an internal magnetic ring clutch member having a flange portion of a lesser diameter secured on the shaft and providing an output to the take-up roller and having a plurality of adjacent north and south pole pairs equally spaced around the exterior surface of the internal clutch member, said clutch members having generally rectangular cross-sectional portions defining substantially concentric mating surfaces spaced from each other to provide an air gap therebetween and having the plurality of adjacent magnetic pole pairs positioned on and occupying the entire circumference of the mating surfaces of the respective clutch member in flanged and overlapping relationship wherein the flange portion of said external clutch member extends and overlaps the flange portion of said internal clutch member and responsive to rotation of the shaft in one direction whereby the repelling forces developed by similar poles produce a maximum torque in one direction to provide tension in the record media and further rotation of the shaft develops attracting forces to cause momentary rotation in the opposite direction to relieve the tension and to uniformly rewind the record media in cyclic manner on the take-up roller.

* * * * *